United States Patent [19]

Schulz

[11] Patent Number: 4,782,917

[45] Date of Patent: Nov. 8, 1988

[54] ADJUSTABLE SCAFFOLD

[76] Inventor: Richard H. Schulz, 845 N. L St., Livermore, Calif. 94550

[21] Appl. No.: 167,361

[22] Filed: Mar. 14, 1988

Related U.S. Application Data

[63] Continuation-in-part of Ser. No. 86,302, Aug. 17, 1987, abandoned.

[51] Int. Cl.[4] ..... B27B 21/00

[52] U.S. Cl. ..... 182/182; 182/131; 182/225

[58] Field of Search ..... 182/182, 131, 132, 225

[56] References Cited

U.S. PATENT DOCUMENTS

| | | | |
|---|---|---|---|
| 376,876 | 1/1888 | Goodrich | 182/182 |
| 850,351 | 4/1907 | Crum | 182/182 |
| 1,147,522 | 7/1915 | Loomis | 182/182 |
| 1,618,305 | 2/1927 | Paulett | 182/182 |
| 1,659,113 | 2/1928 | Marks | 182/182 |
| 2,257,876 | 10/1941 | Berchem | 182/182 |
| 2,376,787 | 5/1945 | Larson | 182/182 |
| 4,375,245 | 3/1983 | Schill | 182/182 |

*Primary Examiner*—Reinaldo P. Machado

*Attorney, Agent, or Firm*—Burns, Doane, Swecker & Mathis

[57] ABSTRACT

An adjustable scaffold having a generally rectangular frame including a pair of clamp sections associated with one side of the frame and a first step section associated with the other side of the frame, pairs of legs pivotly mounted to the frame and said generally rectangular platform having vertically downwardly extending support arms complementary to the clamp sections to support the platform in an offset position closer to one side of the frame than the other, the platform being removable from the clamp sections and storable between the clamp sections and the first step section.

9 Claims, 1 Drawing Sheet

ADJUSTABLE SCAFFOLD

This application is a continuation-in-part of U.S. patent application Ser. No. 07/086,302 filed Aug. 17, 1987 and abanonded.

BACKGROUND OF THE INVENTION

1. Field of the Invention

This invention relates to scaffolds used in applying drywall, plastering, wallpapering and the like for supporting workmen thereon. More specifically, the invention relates to an adjustable scaffold which may be easily and quickly collapsed for storing and shipping purposes and which when assembled provides a maximum support area in close lateral and vertical proximity to a work piece.

2. Prior Art

In the past, various adjustable scaffolds, sometimes called trestles, have been developed to provide an improved support which can be easily and quickly collapsed. See, for example, U.S. Pat. Nos. 850,351; 1,618,305; 1,659,113 and 2,257,876. All of the devices disclosed in these patents provide a vertically adjustable surface which is collapsible for movement and storage. Unfortunately, none of these references discloses an adjustable scaffold-type device which provides a work platform area equal to the top of the frame upon which it depends wherein such platform has a maximum surface area positioned closer to one side of the frame than the other for close access to a lateral wall or work piece.

Likewise, U.S. Pat. Nos. 376,876; 1,147,522; 2,376,787 and 4,375,245 disclose sawhorse-type structures having extensible or adjustable support members. The tops of these members are not intended to be a work platform, but rather are intended to be used in pairs upon which a wooden platform may be placed. None of these references discloses either a sufficient work platform or an offset capability.

It would therefore be highly desirable to have an adjustable scaffold having a generally rectangular frame with pivotly attached legs and having a generally rectangular platform equal in surface area to the rectangular frame wherein the platform nests with respect to the frame for purposes of storage, yet is supported by the frame in an offset position, being closer to one side of the frame than the other, to provide close access to a lateral wall and at the same time wherein the frame provides step-like access to the platform when in the working condition.

SUMMARY OF THE INVENTION

The purpose of the instant invention is to provide an adjustable scaffold that is storable in a compact configuration and which provides a maximum working platform area that is axially offset to be closer to one side of the platform supporting frame than the other, the frame providing step-like members to access the working platform. To accomplish this purpose, there is provided an adjustable scaffold having a generally rectangular frame having a first step section along one side thereof and having clamp sections on the other side thereof, the scaffold including first and second pairs of pivotly mounted legs to support the frame and a generally rectangular platform at least equal in area to the surface area of the frame and having downwardly extending support arms which are complementary to the clamp sections telescopicly supporting the platform in an offset position closer to one side of the frame than the other, the support arms being removable from the clamp sections and storable in a space between the clamp sections and the step section for storage.

In one aspect of the invention there is provided an adjustable scaffold comprising: a generally rectangular frame having ends and sides, said frame having a first step section comprising one side thereof and extending partially across the width of an end of said frame, said frame including a pair of clamp sections, one connected to each end of said frame opposite said first step section, said clamp sections and said first step section defining a space between said clamp sections and said first step section, said space being in general alignment with the longitudinal axis of said frame; first and second pairs of legs pivotly mounted to said frame at the ends thereof, respectively, each of said legs being extensible; and a generally rectangular platform having top and bottom surfaces, the surfaces of said platform being at least equal in area to the surface area of said frame to provide maximum working area relative to the support of said frame, said platform including a pair of downwardly extending support arms which are complementary to said clamp sections and adapted to telescope within said clamp sections and to be secured by said clamp sections at a desired platform position, said platform being transversely closer to one side of said frame than the other when said support arms are secured by clamp sections for close access to a wall that may be adjacent said frame and also allowing access to said platform by said first step section which is inherently offset from said platform, said support arms being removable from said clamp sections and storable in the space between said clamp sections and said first step section, said platform being generally aligned and nested with respect to said frame when said support arms are stored in such space.

DESCRIPTION OF THE PREFERRED EMBODIMENT

The present invention generally comprises a scaffold apparatus for use in applying drywall or the like that has a distinct advantage over conventional scaffolds, the advantage being the legs alone can be extended such that the platform can be quickly lifted from the medial area of the frame and repositioned to one side of the frame at a substantial elevation. The platform employs medially disposed support members at opposing ends that are easily fitted to corresponding clamps joined to one side of the frame. The opposing side of the frame is of wider construction and serves as a stepping means once the platform is so positioned, enabling one to walk up as opposed to climbing up when carrying material The open construction of the platform eliminates the buildup of taping mud, etc. and allows the scaffold to be easily maneuvered with one hand as well as provides a method for securing the platform to the frame.

Figure 1:
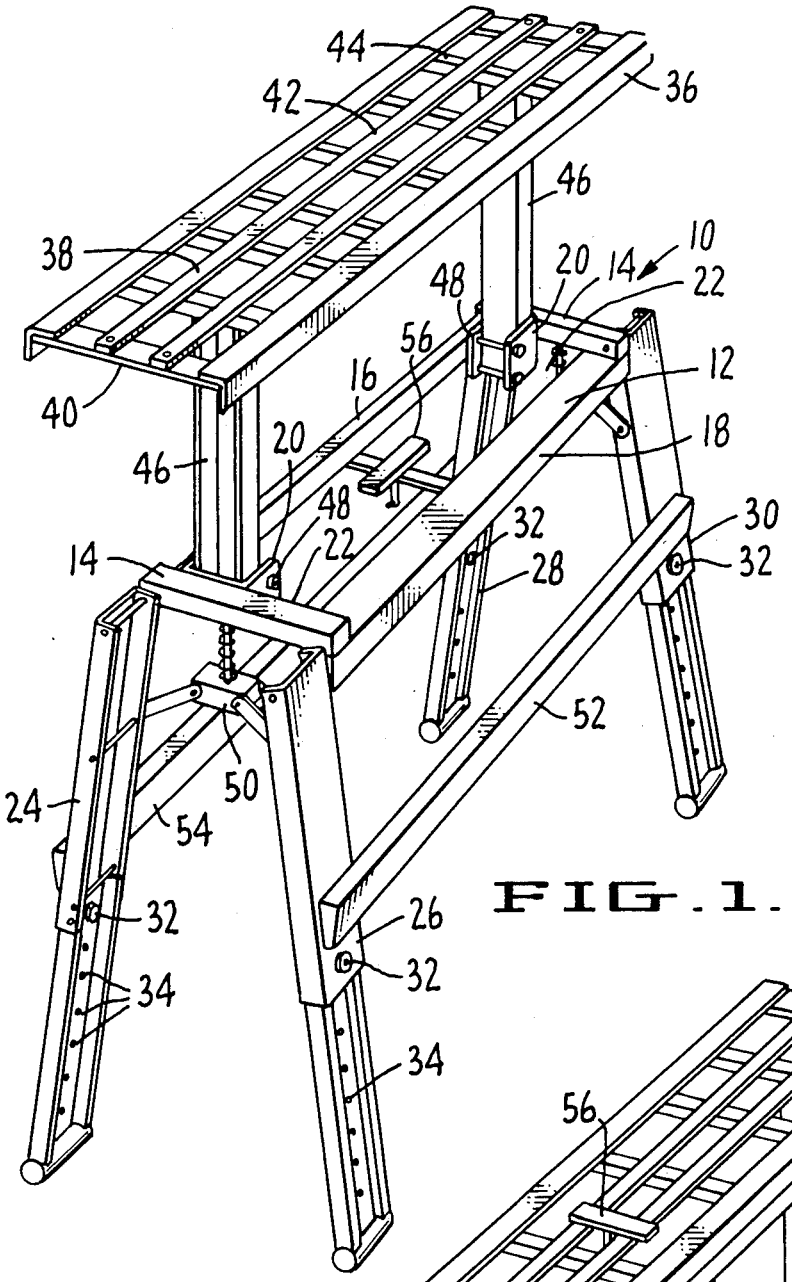
FIG. 1 is a perspective view of the adjustable scaffold in the working position wherein the platform and the legs have been fully extended.

With reference to the drawing, FIG. 1 illustrates the adjustable scaffold shown generally at 10 in the working condition. The scaffold comprises a generally rectangular frame 12 having transverse ends 14 and longitudinal sides 16 and 18, side 18 comprising a first step section noted as 18 which preferably extends no more than approximately one-third the distance across the width of an end 14 of the frame 12. Frame 12 also includes a pair of clamp sections 20, one clamp section connected to each end 14 of the frame 12, preferably inside the frame 12 and opposite the first step section 18. The clamp sections 20 extend partially across the width of the frame 12 defining a space 22 between the clamp sections 20 and the first step section 18. Space 22 is in general alignment with the longitudinal axis of the frame. It is understood that the clamp sections may be integral with side 16.

Figure 2:
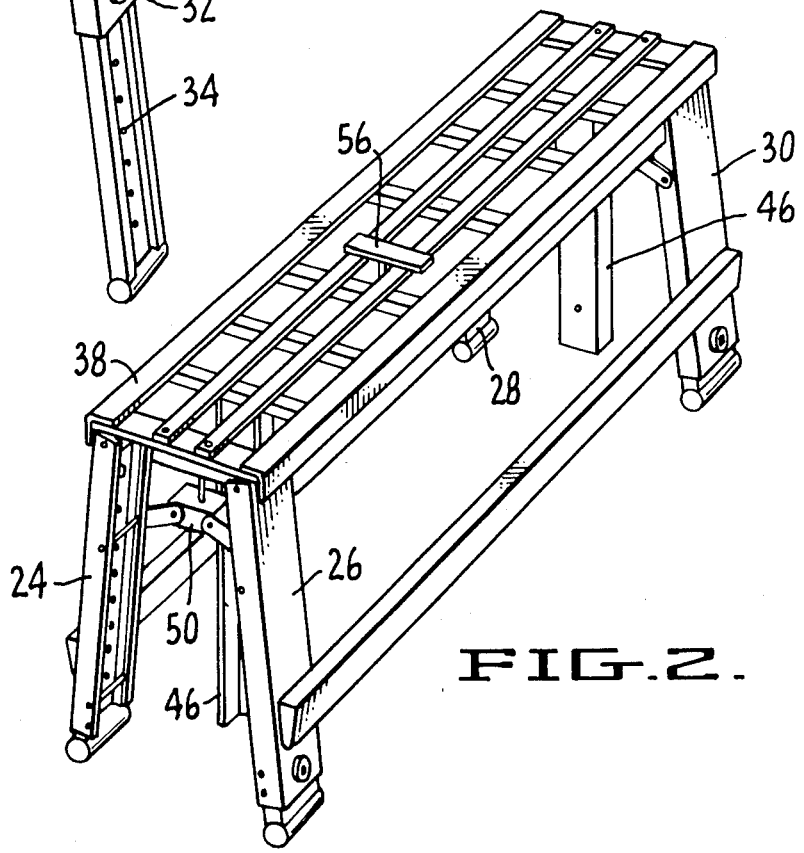
FIG. 2 is a perspective view similar to FIG. 1 wherein the adjustable scaffold is in the storage position, the platform and legs being fully retracted and the pairs of legs pivoted toward each other.

Scaffold 10 also includes a first pair of legs 24 and 26 and a second pair of legs 28 and 30 pivotly mounted to the frame 12 at the ends 14 thereof, each of the legs 24, 26, 28 and 30 being extensible, as can be seen by comparing FIGS. 1 and 2. The legs are secured in the desired position by conventional first lock means 32 which is complementary to apertures 34 in the legs 24, 26, 28 and 30. The first lock means 32 may comprise any conventional hardware (for example, a spring-loaded fastener, a bayonet pin, a bolt and wing nut, etc.) that is capable of adjustably securing the legs to a desired amount of extension. Although apertures 34 are illustrated, it is also within the scope of the invention to provide other known mechanisms such as detents or surface configurations capable of interfacing with first lock means 32.

Frame 12 includes a generally rectangular platform 36 having a top surface 38 and a bottom surface 40, which surfaces are at least equal in area to the surface area of the frame 12 to provide a maximum working or standing area. Platform 36 is shown to be an open grid-like structure of longitudinal members 42 and cross members 44. Other solid or open surfaces, such as expanded metal, which would provide suitable standing support are within the scope of the invention. The platform 36 preferably extends longitudinally beyond the ends of the frame 12, the platform being longer than the frame.

Platform 36 also includes a pair of downwardly extending support arms 46 that are complementary to clamp sections 20 and are adapted to telescope within the clamp sections 20 and to be secured by the clamp sections 20 at a vertical position desired for the platform 36. Support arms 46 are shown to be channel-like members, and clamp sections 20 are illustrated as channel members having flanges, between which flanges are received support arms 46. Clamp sections 20 are shown to include second lock means 48 in the form of a bolt and wing nut which will clamp the flanges of the clamp sections 20 toward each other to engage support arms 46.

It is within the scope of the invention to use other structural members for the support arms 46 such as I-sections and closed box sections, etc. and to use other mechanical expedients for the clamp sections 20 such as a box section in which the support arms 46 are capable of telescoping. Similar to first lock means 32, additional mechanical expedients may be used for the second lock means 48 to secure support arms 46 with respect to rectangular frame 12 and therefore to position platform 36 at the desired vertical height above the frame 12.

It can be seen in FIG. 1 that the platform 36 is closer to one side of the frame 12 than the other when the support arms 46 are secured by said clamp sections 20 for close access to a wall that may be adjacent to the frame 12. Since clamp sections 20 are preferably positioned within the frame 12 adjacent to side 16, the support arms 46, and thus platform 36, are positioned closer to the far side of frame 12, as shown in FIG. 1. The offset of the platform 36 also allows access to the platform 36 by first step section 18 which is inherently offset from the platform 36. Unlike the prior art devices, specifically that shown in U.S. Pat. No. 850,351, the instant invention provides a full width platform 36 which extends beyond the side 16 of the frame 12 to provide both a maximum working surface for standing, etc. and, just as importantly, access by first step section 18.

It can also be seen in FIG. 1 that the support arms 46 are removable from clamp sections 20 and are storable in the space 22 between the clamp sections 20 and the first step section 18. Since the space 22 and the support arms 46 fall generally along the longitudinal centerline of the frame 12, the platform will seat symmetrically about such a centerline when stored. The platform 36 is at least equal in area to the surface area of the frame 12 when the platform 36 is generally aligned and nested with respect to the frame 12, and the support arms 46 are stored in the space 22. Since the legs 24 and 26 and the legs 28 and 30 are pivotal toward each other, as can be seen by comparing FIG. 2 to FIG. 1, it can be seen that adjustable scaffold 10 provides a compact structure wherein a platform 36 of maximum surface area can be compactly stored with respect to a supporting frame and legs, and in working condition can be offset with respect to the frame and legs to provide maximum working area in close proximity to one side of frame 12.

It can be seen in FIG. 2 that platform 36 extends longitudinally beyond support arms 46 to overlap ends 14 and legs 24, 26, 28 and 30 when platform 36 nests with frame 12 for storage. As can more clearly be seen in FIG. 1, pairs of legs are secured in the working condition by cross brace means 50 which is shown to be a conventional spring-loaded mechanism. Other mechanical expedients of locking cross members are considered to be within the scope of the invention.

The figures also illustrate a second step section 52 connected at opposite ends thereof to one of each of the first and second pairs of support legs, specifically to legs 26 and 30, and extending along one side of the frame 12 generally parallel to the first step section 18. In the working condition, second step section 52 and first step section 18 constitute a step-ladder-like means to access platform 36. Scaffold 10 may also be provided with a third step section 54 connected at opposite ends thereof to one of each of the first and second pairs of support legs, specifically, legs 24 and 28, i.e., other than those support legs connected to the second step section 52.

Scaffold 10 further includes platform lock means 56 which is shown to be a vertically extensible and rotatable member which is spring-loaded with respect to frame 12 in a downward position. By comparing FIG. 1 with FIG. 2, it can be seen that platform lock means 56 can be grasped through openings in platform 36 and pulled vertically between the longitudinal members 42 and transverse members 44 and rotated, as seen in FIG. 2, to engage longitudinal members 42 to secure platform 36 with respect to frame 12 for storage purposes.

Although the present invention has been described with particular reference to the preferred embodiment, such disclosure should not be interpreted as limiting. Alternatives and other modifications will no doubt become apparent to those skilled in the art after having read the preceding disclosure.

What is claimed is:

1. An adjustable scaffold comprising:

a generally rectangular frame having ends and sides, said frame having a first step section comprising one side thereof and extending partially across the width of an end of said frame, said frame including a pair of clamp sections, one connected to each end of said frame opposite said first step section, said clamp sections and said first step section defining a space between said clamp sections and said first step section, said space being in general alignment with the longitudinal axis of said frame;

first and second pairs of legs pivotly mounted to said frame at the ends thereof, respectively, each of said legs being extensible; and a generally rectangular platform having top and bottom surfaces, the surfaces of said platform being at least equal in area to the surface area of said frame to provide maximum working area relative to the support of said frame, said platform including a pair of downwardly extending support arms which are complementary to said clamp sections and adapted to telescope within said clamp sections and to be secured by said clamp sections at a desired platform position, said platform being transversely closer to one side of said frame than the other when said support arms are secured by clamp sections for close access to a wall that may be adjacent said frame and also allowing access to said platform by said first step section which is inherently offset from said platform, said support arms being removable from said clamp sections and storable in the space between said clamp sections and said first step section, said platform being generally aligned and nested with respect to said frame when said support arms are stored in such space.

2. A scaffold as in claim 1 wherein said clamp sections are connected to said frame inside said frame.

3. A scaffold as in claim 2 wherein said first step section extends approximately one-third of the way across the width of said frame.

4. A scaffold as in claim 1 further including a second step section connected at the opposite ends thereof to one of each of said first and second pairs of support legs and extending along one side of said frame generally parallel to said first step section.

5. A scaffold as in claim 2 further including a third step section connected at opposite ends thereof to one of each of said first and second pairs of support legs other than those support legs connected to said second step section.

6. A scaffold as in claim 2 further including lock means connected to said frame and capable of engaging said platform when said support arms are stored in the space between said clamp sections and said step section to secure said platform with respect to said frame for transport and storage.

7. A scaffold as in claim 3 wherein said platform is an open grid-like structure and said lock means comprises a spring-loaded member that can extend through said open grid and when rotated creates an interference contact with said grid.

8. A scaffold as in claim 1 wherein said platform is longer than said frame.

9. A scaffold as in claim 1 wherein said first and second pairs of legs longitudinally beyond said ends of said frame and said platform extend beyond said legs, the surface area of said platform exceeding the surface area of said frame.

* * * * *

UNITED STATES PATENT AND TRADEMARK OFFICE

CERTIFICATE OF CORRECTION

PATENT NO. : 4,782,917

DATED : November 8, 1988

INVENTOR(S) : Richard H. Schulz

It is certified that error appears in the above-identified patent and that said Letters Patent is hereby corrected as shown below:

Column 1, line 6, delete "abanonded" and insert --abandoned--.

Column 4, line 49, delete "step-ladder-like" and insert -- stepladder-like --.

Signed and Sealed this

Twenty-seventh Day of February, 1990

*Attest:*

JEFFREY M. SAMUELS

*Attesting Officer*

*Acting Commissioner of Patents and Trademarks*